US005975009A

United States Patent [19]

Nihra et al.

[11] Patent Number: 5,975,009

[45] Date of Patent: Nov. 2, 1999

[54] FLAG RETAINING MECHANISM

[76] Inventors: Thomas E. Nihra; Deni H. Nihra, both of 31211 Kingswood Blvd., Novi, Mich. 48377

[21] Appl. No.: 08/907,597

[22] Filed: Aug. 8, 1997

Related U.S. Application Data

[63] Continuation of application No. 08/658,163, Jun. 4, 1996, abandoned.

[51] Int. Cl.[6] ..... G09F 17/00

[52] U.S. Cl. ..... 116/173; 116/174; 24/552; 40/607

[58] Field of Search ..... 116/173, 174; 40/607, 617; 24/67.9, 546, 552

[56] References Cited

U.S. PATENT DOCUMENTS

| | | | |
|---|---|---|---|
| 1,276,560 | 8/1918 | Myers | 24/552 |
| 2,799,240 | 7/1957 | Andrews | 116/174 |
| 3,105,278 | 10/1963 | Sponsel | 24/552 |
| 3,183,886 | 5/1965 | Moffitt, Jr. | 116/173 |
| 3,225,734 | 12/1965 | Bule | 116/173 |
| 3,234,616 | 2/1966 | Wantland | 24/546 |
| 4,864,962 | 9/1989 | Kuehl et al. | 116/173 |
| 4,944,656 | 7/1990 | Feng et al. | 116/173 |
| 5,383,420 | 1/1995 | Dundorf | 116/173 |
| 5,509,371 | 4/1996 | Phillips | 116/173 |

OTHER PUBLICATIONS

*1995 Supplemental Price Catalog*, Eder Flag Manufacturing Company, Inc. "The Telescoping Flagpole", "Pole Grips". 1994 Supplemental Price Catalog, Eder Flag Manufacturing Company, Inc., p. 46, 1994.

*Primary Examiner*—Andrew Hirshfeld
*Attorney, Agent, or Firm*—Reising, Ethington, Barnes, Kisselle, Learman & McCulloch, P.C.

[57] ABSTRACT

There is illustrated and described herein a flag retaining mechanism including a telescopic pole and a pair of improved retainer clips for retaining the flag in a fixed location on the pole. Each clip includes a full circle ring for gripping a pole, first and second legs diverging from the ring, a bend formed on the end of the first leg, an extension extending laterally from the bend toward the second leg to provide a flag support segment, and interconnectable hooks formed on the distal ends of the extension and the second leg to prevent the segment and leg from separating while a flag is mounted thereon.

4 Claims, 1 Drawing Sheet

10
12
14
16
18
20
22
24
25
26
27
28
30
32
34
36
38
40
42
44
46
48
50
52
22,24
3

FLAG RETAINING MECHANISM

This is a continuation of application Ser. No. 08/658,163, filed on Jun. 4, 1996 now abandoned.

FIELD OF THE INVENTION

This invention relates generally to flags and holding mechanisms therefor, and, more particularly, to an improved retainer clip and telescopic pole for displaying and/or waving flags.

BACKGROUND ART

Feng U.S. Pat. No. 4,944,656 discloses a telescopic rod including a reel pole carrying a flag, and a hollow handle having a longitudinal slit formed in the handle. The assembly is adapted to accommodate the retraction of the reel pole into the handle and the flag around the pole within the handle.

A telescoping flagpole and a pair of pole grips are illustrated in Eder Flag Manufacturing Co., Inc. 1995 Supplemental Price Catalog. Each of the clips includes a ring portion for gripping a pole, and a flag holding portion with releasable interconnected ends.

DISCLOSURE OF THE INVENTION

A general object of the invention is to provide an improved retainer clip and telescopic pole for retaining flags while being displayed and/or waved.

Another object of the invention is to provide a retainer clip which retains a flag in a selected place on a pole while resisting any tendency to move along the pole in windy conditions or while being vigorously waved.

A further object of the invention is to provide a flag retainer clip including a full circle ring for gripping a pole, first and second legs diverging from the ring, a bend formed on the end of the first leg, an extension extending laterally from the bend toward the second leg to provide a flag support segment, and interconnectable hooks formed on the distal ends of the extension and the second leg to prevent the segment and leg from separating while a flag is mounted thereon.

These and other objects and advantages will become more apparent when reference is made to the following drawings and the accompanying description.

BEST MODE FOR CARRYING OUT THE INVENTION

Figures 1, 2, 3, 4:
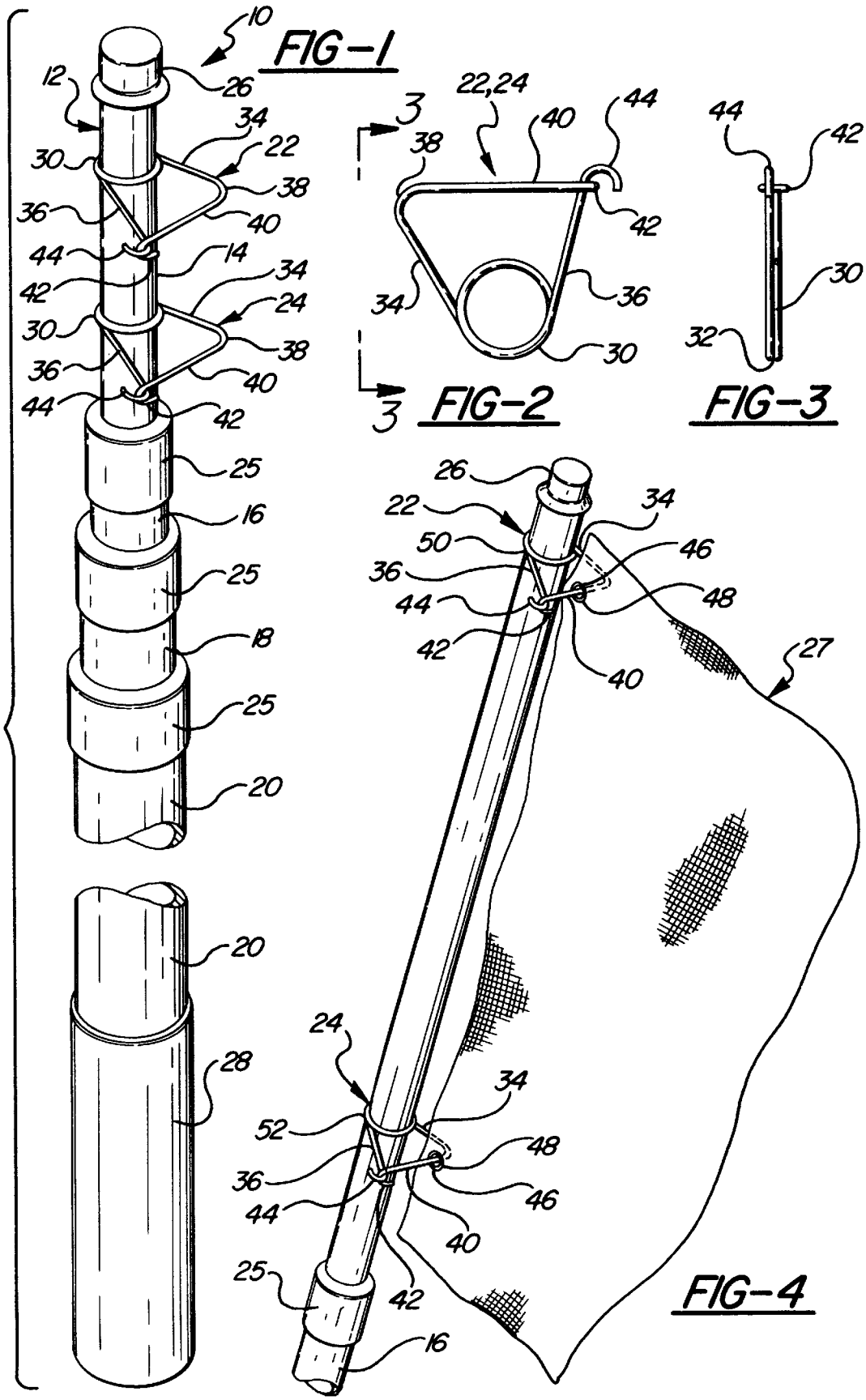
FIG. 1 is a fragmentary telescopic pole and a pair of retainer clips embodying the invention.
FIG. 2 is a plan view of the inventive retainer clip.
FIG. 3 is an end view taken along the plane of the line 3—3 of FIG. 2, and looking in the direction of the arrows.
FIG. 4 is a fragmentary view of a telescopic pole with the two retainer clips of FIG. 1 spread apart along one segment of the pole, and holding a flag in place on the pole.

Referring now to the drawings in greater detail, FIG. 1 illustrates a flag support assembly 10 including a telescopic pole 12 having a selected plurality of segments, such as segments 14, 16, 18 and 20, and two retainer clips 22 and 24 slidably mounted on the innermost pole segment 14 to receive and support a flag 27 (FIG. 4), as will be explained. A plastic sleeve 25 is mounted on the outer end of each segment 16, 18 and 20. An end cap 26 is mounted on the free end of the segment 14, and a hand grip 28 may be mounted on the free end of the outer segment, such as the segment 20.

As shown in FIGS. 2 and 3, each clip 22 and 24 is formed to include a spiral ring 30 abutted together at its overlapped portion 32, with tangentially extending legs 34 and 36 on the opposite ends of the ring 30 diverging outwardly therefrom. A bend 38 is formed on the end of the leg 34, and an extension 40 extends laterally from the bend toward the other leg 36. A first substantially U-shaped hook 42 is formed on the distal end of the extension 40. A second substantially U-shaped hook 44 is formed on the distal end of the leg 36, the plane of which is at a right angle to the plane of the first U-shaped hook. Upon the manual urging of the legs 34 and 36 toward one another, the hooks 42 and 44 are adapted to interconnect upon the release of the legs, such that neither hook can slip past the other in response to any external pull on the flag, such as would occur under windy conditions.

Referring now to FIG. 4, in operation, the telescopic pole segment 14 is pulled out from the next segment 16. While the clip 22 tends to remain fixed in place, the clip 24 is manually forced slidingly down the segment 14 a distance equal to the width of the selected flag 27, the latter having corner holes 46 formed therein and grommets 48 mounted around the respective holes.

The spiral rings 30 of the respective clips 22 and 24 grip the pole segment 14 so tightly that, when positioned at locations, such as represented at 50 and 52, they do not slide under foreseeable external forces.

By manually pressing the legs 34 and 36 together and separating them, a grommet 48 on the flag 27 is mounted over the hook 42 onto the extension 40. The hooks 42 and 44 are then reconnected as described above. The flag 27 may now be waved vigorously or allowed to be subjected to strong winds, without any separation or slippage of the clips 22 and 24 past one another.

Industrial Applicability

It should be apparent that the invention provides an improved and highly efficient flag retainer clip and telescopic pole mechanism, that can be easily carried by an individual, and then extended for use at functions such as football games or parades, for example, or mounted in front of homes or other buildings.

While but one embodiment of the invention has been shown and described, other modifications are possible within the scope of the following claims.

What is claimed is:

1. A flag retaining mechanism including a telescopic pole having a plurality of segments, a pair of retainer clips manually slidably mounted on the smallest diameter segment of said plurality of segments, said retainer clips adapted to retain a flag thereon, characterized by each of said clips including a full circle ring adapted to being manually moved along the smallest diameter segment to a selected position thereon and thereafter gripping said smallest diameter segment to hold said selected position, first and second tangentially extending legs diverging from the ring, a bend formed on the end of the first leg, a straight extension extending laterally from the bend directly to the second leg at a substantially right angle therewith to provide a laterally slidable flag support segment, and interconnectable hooks formed on the distal ends of the extension and the second leg, wherein the hook on the second leg is substantially U-shaped and extends outwardly away from the first leg along a plane substantially parallel to a plane formed by the extension and the first leg, said hook on the second leg bending over the hook on the extension when the first and second legs interconnected, wherein the hook on the extension is movable along the second leg, and the laterally slidable flag support segment and the second leg are prevented from separating when the flag is mounted thereon and is subjected to bi-directional external forces.

2. The flag retaining mechanism described in claim 1, wherein said hook of the extension is substantially U-shaped and the planes of said respective hooks on each clip are at a right angle to one another.

3. The flag retaining mechanism described in claim 1, wherein said full circle ring of each of said clips is a spiral ring having overlapping portions between the tangentially extending legs.

4. The flag retaining mechanism described in claim 3, wherein said overlapping portions of each of said clips abut against one another.

* * * * *